US011075452B2

(12) United States Patent
Crouch et al.

(10) Patent No.: US 11,075,452 B2
(45) Date of Patent: Jul. 27, 2021

(54) WIDEBAND FREQUENCY SELECTIVE ARMORED RADOME

(71) Applicant: Raytheon Company, Waltham, MA (US)

(72) Inventors: David D. Crouch, Eastvale, CA (US); Larry C. Martin, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 67 days.

(21) Appl. No.: 16/659,985

(22) Filed: Oct. 22, 2019

(65) Prior Publication Data

US 2021/0119330 A1 Apr. 22, 2021

(51) Int. Cl.

| | |
|---|---|
| ***H01Q 1/42*** | (2006.01) |
| ***H01Q 1/48*** | (2006.01) |
| ***H01Q 15/00*** | (2006.01) |
| *H01Q 21/06* | (2006.01) |

(52) U.S. Cl.

CPC ..... *H01Q 1/42* (2013.01); *H01Q 1/48* (2013.01); *H01Q 15/0013* (2013.01); *H01Q 21/062* (2013.01); *H01Q 21/065* (2013.01)

(58) Field of Classification Search

CPC combination set(s) only.
See application file for complete search history.

(56) References Cited

U.S. PATENT DOCUMENTS

| | | | |
|---|---|---|---|
| 6,476,771 | B1 | 11/2002 | McKinzie, III |
| 7,605,767 | B2 | 10/2009 | Lee et al. |
| 7,688,278 | B2 | 3/2010 | Frenkel |
| 7,737,899 | B1 | 6/2010 | McKinzie, III |
| 7,817,099 | B2 | 10/2010 | Wu et al. |
| 8,325,093 | B2 | 12/2012 | Holland et al. |
| 8,599,095 | B2 | 12/2013 | Wu |
| 9,099,777 | B1 | 8/2015 | Manry, Jr. |

(Continued)

FOREIGN PATENT DOCUMENTS

| | | | |
|---|---|---|---|
| WO | WO 2016/138267 A1 | 9/2016 | |
| WO | WO-2016138267 A1 * | 9/2016 | ..... H01Q 9/065 |

OTHER PUBLICATIONS

U.S. Non-Final Office Action dated Sep. 17, 2020 for U.S. Appl. No. 16/415,292; 13 Pages.

(Continued)

*Primary Examiner* — Graham P Smith
*Assistant Examiner* — Jae K Kim
(74) *Attorney, Agent, or Firm* — Daly, Crowley, Mofford & Durkee LLP

(57) ABSTRACT

An armored radome includes an electrically-conductive ground plane that provides load bearing and/or ballistic protection to a shielded sensor, and a pair of radiator structures on opposing surfaces of the ground plane. The radiator structures each include an antenna, and the ground plane includes one or more coaxial feedthroughs that couple the antennas for reradiation of signals. One or both of the radiator structures may include a frequency-selective surface (FSS) according to a desired operating frequency range or to shape a frequency response of the radome. The disclosed radome is both mechanically strong, and electromagnetically transparent, or nearly so, across a wide range of frequencies and transmit/receive angles.

12 Claims, 11 Drawing Sheets

(56) References Cited

U.S. PATENT DOCUMENTS

| | | | | |
|---|---|---|---|---|
| 9,172,147 | B1 | 10/2015 | Manry, Jr. | |
| 9,437,929 | B2 | 9/2016 | Isom et al. | |
| 9,537,208 | B2 | 1/2017 | Isom | |
| 9,780,458 | B2 | 10/2017 | Viscarra et al. | |
| 10,062,962 | B2 | 8/2018 | Kolak et al. | |
| 10,153,547 | B2 | 12/2018 | Crouch | |
| 10,424,847 | B2 | 9/2019 | Isom et al. | |
| 2013/0300612 | A1* | 11/2013 | Shiue | H01Q 9/0407 343/700 MS |
| 2018/0040955 | A1 | 2/2018 | Vouvakis et al. | |
| 2019/0081411 | A1 | 3/2019 | Isom et al. | |
| 2019/0356058 | A1 | 11/2019 | Martin et al. | |
| 2020/0243951 | A1* | 7/2020 | Liu | H01Q 25/005 |
| 2020/0411961 | A1* | 12/2020 | Kasani | H01Q 3/34 |
| 2020/0412011 | A1* | 12/2020 | Bisiules | H01Q 21/062 |

OTHER PUBLICATIONS

Elsallal et al., "Electronically Scanned Arrays of Dual-Polarized, Doubly-Mirrored Balanced Antipodal Vivaldi Antennas (DmBAVA) Based on Modular Elements;" IEEE Antennas and Propagation Society International Symposium, IET Conference; Jul. 9, 2006; 4 Pages.

Holland et al., "A 7-21 GHz Dual-Polarized Planar Ultrawideband Modular Antenna (PUMA) Array;" IEEE Transactions on Antennas and Propagation, vol. 60, No. 10; Oct. 2012; 12 Pages.

Holland et al., "Design and Fabrication of Low-Cost PUMA Arrays;" 2011 IEEE International Symposium on Antennas and Propagation (APSURSI); Jul. 8, 2011; 4 Pages.

Holland et al., "The Planar Ultrawideband Modular Antenna (PUMA) Array;" IEEE Transactions on Antennas and Propagation, vol. 60, No. 1; Jan. 2012; 11 Pages.

Kindt et al., "A 6:1 Bandwidth PUMA Array at 7mm Scale;" 2016 IEEE International Symposium on Phased Array Systems and Technology (APSURSI); Oct. 2016; 4 Pages.

Kindt et al., "Polarization Correction in Dual-Polarized Phased Arrays of Flared Notches;" 20111 IEEE International Symposium on Antennas and Propagation (APSURSI); Jul. 2, 2011; 4 Pages.

Kindt et al., "Wavelength-Scaled Ultra-Wide Bandwidth Multi-Function Phased Arrays;" 2010 IEEE International Conference on Wireless Information Technology and Systems; Aug. 28, 2010; 4 Pages.

Kindt et al., "Ultrawideband All-Metal Flared-Notch Array Radiator;" IEEE Transactions on Antennas and Propagation, vol. 58, No. 11; Nov. 2010; 8 Pages.

Lee et al., "A Low-Profile Wide-Band (5:1) Dual-Pol Array;" IEEE Antennas and Wireless Propagation Letters, vol. 2; Jan. 2003; 4 Pages.

Lee et al., "Simplified Design of 6:1 PUMA Arrays;" 2015 IEEE International Symposium on Antennas and Propagation & USNC/URSI National Radio Science Meeting; Jul. 19, 2015; 2 Pages.

Lee et al., "Wide Band Bunny-Ear Radiating Element;" IEEE Transactions on Antennas and Propagation;. Jun. 28, 1993; 4 Pages.

Logan et al., "A New Class of Planar Ultrawideband Modular Antenna Arrays with Improved Bandwidth;" IEEE Transactions on Antennas and Propagation, vol. 66, No. 2; Feb. 2018; 10 Pages.

Logan et al., "A Review of Planar Ultrawideband Modular Antenna (PUMA) Arrays;" Proceedings of the 2013 International Symposium on Electromagnetic Theory; May 20, 2013; 4 Pages.

Logan et al., "Opportunities and Advances in Ultra-Wideband Electronically Scanned Arrays;" 2016 IEEE International Symposium on Antennas and Propagation (APSURSI); Jun. 26, 2016; 2 Pages.

Ludwig, "The Definition of Cross Polarization;" IEEE Transactions on Antennas and Propagation; Jan. 1973; 4 Pages.

Munk et al., "A Low-Profile Broadband Phased Array Antenna;" IEEE Antennas and Propagation Society International Symposium, vol. 2; Jun. 2003; 4 Pages.

Schaubert et al., "Wide Bandwidth Arrays of Vivaldi Antennas;" 2008 Institution of Engineering and Technology Seminar on Wideband, Multiband Antennas and Arrays for Defence or Civil Applications (IET Conference); Mar. 13, 2008; 20 Pages.

Sikina, "Wide Angle Impedance Matching Techniques for Volumetrically Scanned Phased Arrays;" 2010 IEEE International Symposium on Phased Array Systems and Technology (Array); Oct. 12, 2010; 6 Pages.

Syed et al., "Design of Connected Array Loaded with Artificial Dielectric at 60 GHz;" 2013 IEEE Antennas and Propagation Society and International Symposium (APSURSI); Jul. 6, 2014; 2 Pages.

PCT International Search Report and Written Opinion dated Sep. 16, 2019 for International Application No. PCT/US2019/032803, 16 Pages.

PCT International Preliminary Report dated Dec. 3, 2020 for International Application No. PCT/US2019/032803; 9 Pages.

* cited by examiner

WIDEBAND FREQUENCY SELECTIVE ARMORED RADOME

FIELD

The disclosure pertains generally to antenna housings, and more particularly to radomes that have a good electrical response across a wide range of desired frequencies and incident angles while providing mechanical (e.g. ballistic) protection to the underlying antenna.

BACKGROUND

When designing a radome, one is often forced to make tradeoffs between the electrical and mechanical properties of candidate materials. For example, materials having desirable electrical properties (e.g. low dielectric constant and low loss) rarely offer superior mechanical properties, while materials having desirable mechanical properties (e.g. high tensile strength) seldom have the desired electrical properties. Existing armored radomes rely either on thick perforated metal plates or thick and/or multiple layers of high strength dielectric, thus falling into the latter category. While either option provides ballistic resistance, both suffer from limitations on bandwidth and the angles of radiation receipt and/or transmission.

SUMMARY OF DISCLOSED EMBODIMENTS

Disclosed embodiments provide a radome architecture that decouples the two sets of material requirements. A load-bearing member supports, on both of its sides, radiating structures (e.g. antennas) that are coupled to pass electrical signals through the member with a minimum of loss. The load-bearing member may be, for example, a conductive metal that serves as both ballistic protection and as a common electrical ground plane for the radiating structures. The radiating structures, meanwhile, may have any desired electrical or radiative properties and may be physically coupled for signal propagation using holes through the load-bearing member that do not compromise the latter's electrical or mechanical properties.

Thus, in various embodiments, a radome has a high-strength (e.g. ballistic) ground plane and both the interior and exterior radome surfaces comprise an array-like antenna, with the two antennas coupled via one or more coaxial elements that feed through the ground plane. Either or both of the radome surfaces may include one or more frequency-selective surfaces (FSS) for shaping the frequency response. If two such surfaces are used in an embodiment, the periodicities of the two surfaces may or may not be identical, and the surfaces themselves may or may not made from identical materials.

Coaxial feedthroughs are advantageous in that they have no cutoff frequency (unlike waveguides) and are inherently ultra-wideband. Moreover, their use allows the radome designer to choose the material for the thick, load-bearing ground plane based primarily on its mechanical properties; for example, it can be a high-strength lightweight metal or alloy such as T6061-T6 aluminum or titanium. The ground plane can also be plated dielectric if weight minimization is desired. Also advantageously, the array-like outer surface can be engineered to endow the radome with desirable performance characteristics not possible with conventional multilayer dielectric radomes. For example, embodiments offer wideband and wide angle performance not found in other radomes.

Thus, a first embodiment is a radome for a radio frequency (RF) sensor. The radome has an electrically-conductive ground plane providing ballistic protection to the RF sensor. The radome also has a first radiator structure coupled to a first surface of the ground plane for receiving RF signals in a given frequency range, and a second radiator structure coupled to a second, opposing surface of the ground plane for reradiating the received RF signals toward the RF sensor. The first radiator structure and the second radiator structure each include an array antenna, and the ground plane has a plurality of coaxial feedthroughs coupling the array antenna of the first radiator structure to the array antenna of the second radiator structure.

In some embodiments, the given frequency range includes a portion of the radio spectrum between 1 GHz and 100 GHz.

In some embodiments, each of the array antennas includes a plurality of array elements, and the ground plane includes coaxial feedthroughs for communicating the received RF signals from each antenna element in the first radiator structure to a corresponding, physically-aligned antenna element in the second radiator structure.

In some embodiments, the electrically conductive ground plane comprises a metallic conductor, or a metal coated with a conductor, or a dielectric coated with a conductor.

In some embodiments, the first radiator structure, or the second radiator structure, or both, further comprise a frequency-selective surface (FSS) according to the given frequency range. Some embodiments include another FSS for shaping a frequency response of the radome. In some embodiments, each FSS comprises a dielectric having one or more layers of patterned conductor. And in some embodiments, the first radiator structure comprises a first FSS, the second radiator structure comprises a second FSS, and the first FSS and the second FSS share a surface periodicity but are made from different materials.

In some embodiments, each antenna array comprises a tightly-coupled dipole array or a patch antenna array.

DESCRIPTION OF THE SEVERAL VIEWS OF THE DRAWING

The manner and process of making and using the disclosed embodiments may be appreciated by reference to the drawings, in which like structures appearing in more than one view are designated by the same reference characters, and in which.

DETAILED DESCRIPTION

Figure 1:
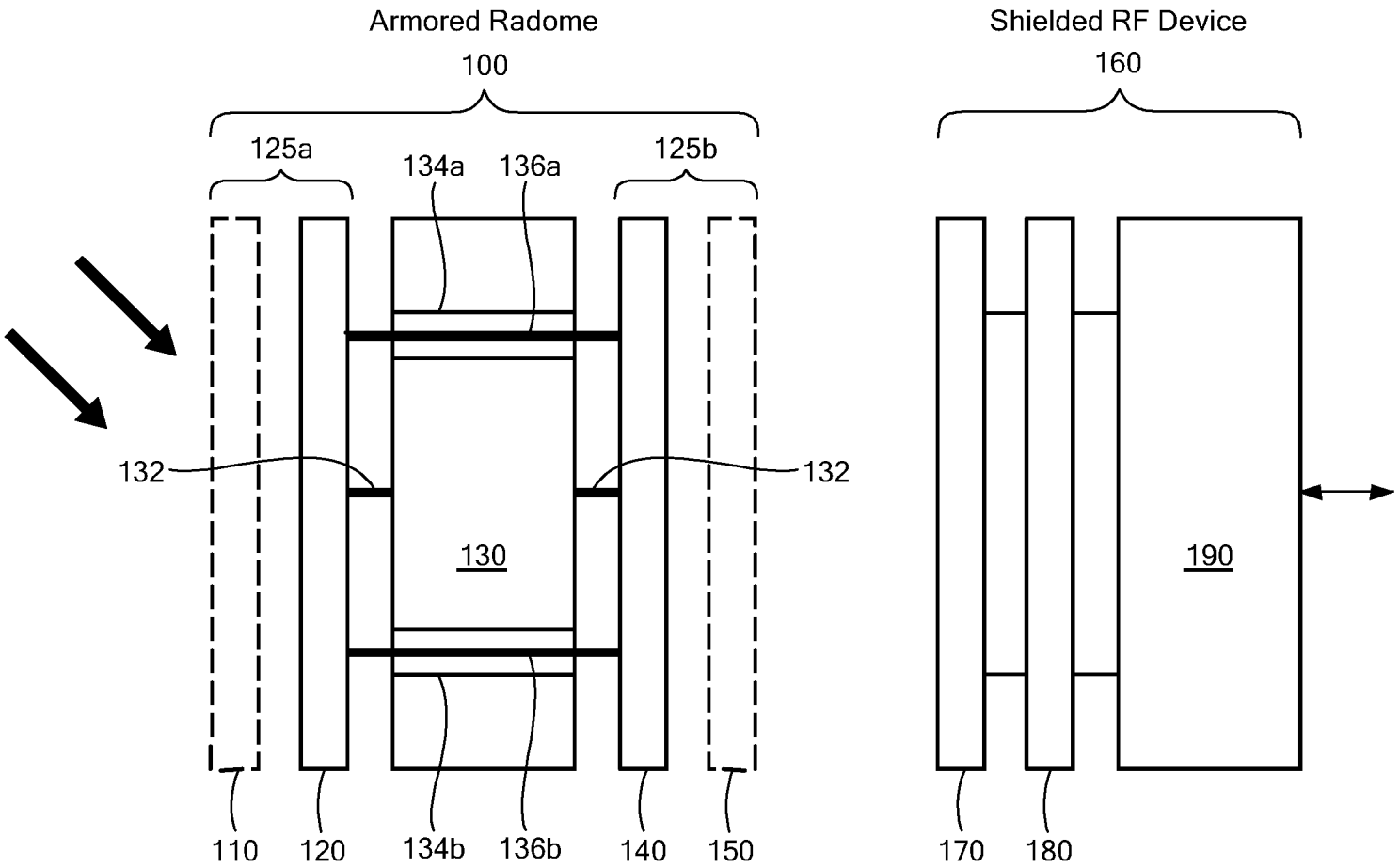
FIG. 1 schematically shows an antenna, shielded by an armored radome in accordance with an embodiment.

Referring to FIG. 1, there is shown an armored radome 100 providing ballistic protection to a shielded radio frequency (RF) device 160 against projectiles arriving from the left of the Figure. It should be understood that, in various embodiments, the armored radome 100 surrounds the shielded RF device 160 to protect it against projectiles coming from any direction, and thus that FIG. 1 is merely illustrative of the concepts, structures, and techniques disclosed herein.

The illustrative armored radome 100 includes a first optional frequency-selective surface (FSS) 110, a first antenna 120, a ground plane 130, a second antenna 140, and a second optional FSS 150, A first radiator structure 125*a* is the collective name for all of the radome structures borne on a first surface of the ground plane 130, including at least the first optional FSS 110 (if present) and the first antenna 120. A second radiator structure 125*b* is the collective name for all of the radome structures borne on the opposing, second surface of the ground plane 130, including at least the second antenna 140 and the second optional FSS 150 (if present).

As is known in the art, a frequency-selective surface (FSS) is any thin, repetitive surface designed to reflect, transmit, or absorb electromagnetic fields based on frequency, i.e. a surface that acts as a microwave filter. For example, an FSS may be a dielectric having one or more layers of patterned conductor. The first and second optional frequency-selective surfaces 110, 150 each may be provided as any FSS known in the art according to a given frequency range, e.g. an operating range of the antennas 120, 140 in the L, S, C, X, $K_u$, K, $K_a$, Q, V, or W radio frequency bands between 1 gigahertz (GHz) and 100 GHz.

In various embodiments, the ground plane 130 may be made of a high-conductivity metal, or a high-strength metal or alloy that is coated with a high-conductivity metal. Alternately, if having a low design weight is a significant factor, the ground plane 130 may be a high-strength, light-weight dielectric that is coated with a high-conductivity metal. It is appreciated that the principle functions of the ground plane 130 are mechanical strength and acting as an electrical ground as discussed in more detail below, and therefore any material or combination of materials that provides these simultaneous properties may be used.

In illustrative embodiments, the ballistic protection for the armored radome 100 is provided primarily by the ground plane 130. Therefore, while one or both of FSS 110, 150 may provide ballistic protection, such protection is not considered essential to the operation of embodiments. Rather, if an FSS is present it may be used primarily for its microwave transmission properties. It is then appreciated that the FSS 110 and the FSS 150 may be provided using any convenient materials, including different materials. For example, to the extent that additional ballistic protection is desired, the first, external FSS 110 may be provided using a sturdier material than the second, internal FSS 150, which may be provided using a material that is selected for its weight or cost. A person having ordinary skill in the art may see how to adapt these concepts, structures, and techniques to suit other design requirements for an armored radome 100.

Furthermore, while FIG. 1 shows one optional FSS on either side of the ground plane 130, it is appreciated that either the first radiator structure 125*a*, the second radiator structure 125*b*, or both structures may include any number of additional frequency-selective surfaces (not shown) according to a desired electrical property of the armored radome 100. Thus, for example, either radiator structure 125*a* or 125*b* (or both) may include an FSS for shaping a frequency response of the armored radome 100.

The first and second antennas 120, 140 may be provided using any appropriate design and materials, for example as tightly-coupled dipole arrays (TCDAs) or arrays of patch elements. It is appreciated that the concepts, structures, and techniques disclosed herein may be used with other types of antennas, and thus that the particular parameters (e.g. operating range, element size, shape, etc.) for the first and second antennas 120, 140 is not seen as essential to the operation of embodiments. Rather, it is appreciated that an armored radome 100 may be designed to achieve these parameters.

In some embodiments, and depending on the particular type of antenna element that is used, the first and second antennas 120, 140 may be electrically grounded using the same ground plane 130 via optional conductors 132. While FIG. 1 shows each antenna 120, 140 grounded via a single conductor, various embodiments using array antennas may provide separate grounding connections for each antenna element, or group of nearby antenna elements, or provide a different grounding mechanism. Thus, it is appreciated that the one-ground-per-antenna shown in FIG. 1 is merely illustrative, and embodiments are not so limited.

The ground plane 130 has one or more holes 134*a*, 134*b* that permit the first and second antennas 120, 140 to be electrically coupled to each other using one or more coaxial feedthroughs 136*a*, 136*b*. The coaxial feedthroughs 136*a*, 136*b* may be any suitable electrical conductor. As is known in the art, the conductive ground plane 130 blocks or attenuates electromagnetic signals across a wide range of frequencies due to its conductive properties. However, the coaxial feedthroughs 136*a*, 136*b* communicate electromagnetic signals between opposite sides of the ground plane 130 with little or no distortion or loss, thereby rendering the ground plane 130 effectively transparent. Meanwhile, the ground plane 130 may provide any desired level of ballistic protection against incoming projectiles.

Thus, the armored radome 100 has advantageous electrical and material properties that are provided by different materials and structures. In particular, a person having ordinary skill in the art has considerable flexibility to tailor to a particular application the materials and structures used in a radome, without deviating from the principles of the radome architecture described herein.

The shielded RF device 160 includes an antenna 170, a transceiver circuit 180, and a signal processing circuit 190.

The antenna 170, transceiver circuit 180, and signal processing circuit 190 may be any hardware or software known in the art to provide RF signal generation or processing. They are shown in FIG. 1 only to illustrate the advantageous electrical and mechanical properties of the armored radome 100, namely providing both ballistic protection and broadband, wide-angle transmission and reception capabilities for the shielded RF device 160. It is thus appreciated that an armored radome 100 may be designed for use with a wide variety of shielded RF devices, and therefore that the particular design of the shielded RF device 160 of FIG. 1 should not be viewed as limiting the scope of disclosed embodiments.

Figure 2A:
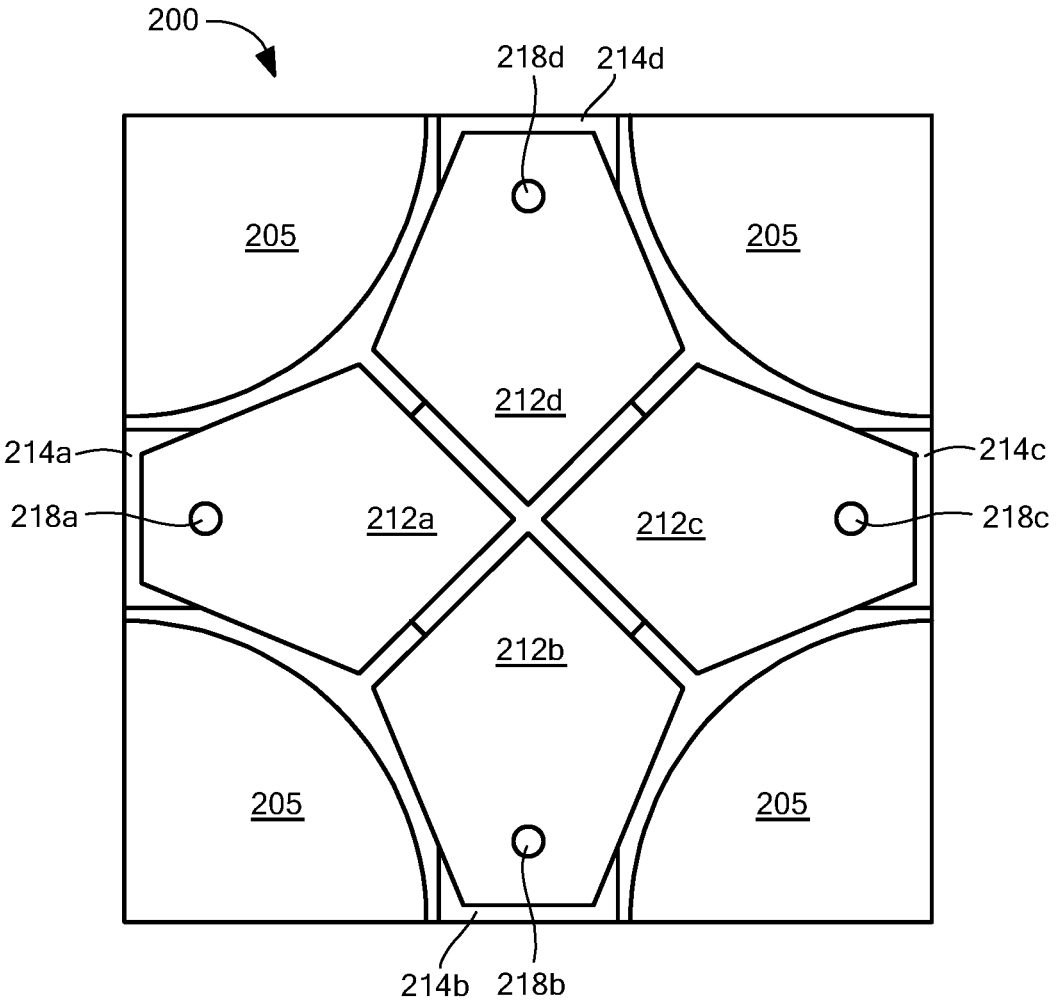
FIG. 2A schematically shows a top view of a unit cell of an armored radome in accordance with a first dual-polarized, tightly-coupled dipole array (TCDA) embodiment, the unit cell having four coaxial feedthroughs, two for each orthogonal dipole, with cover layers removed for clarity.
Figure 2B:
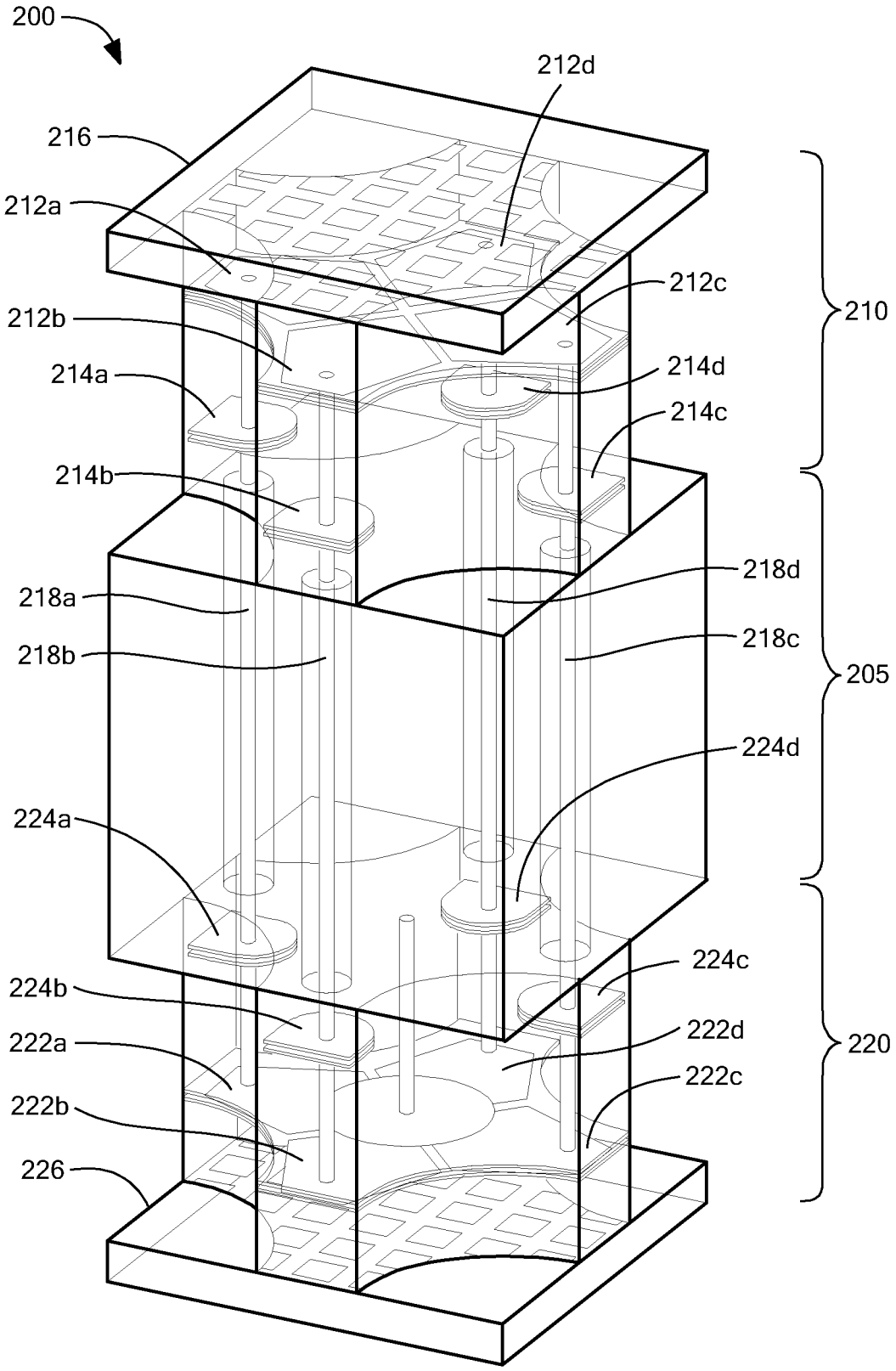
FIG. 2B schematically shows a perspective view of the unit cell of the four-feedthrough TCDA embodiment.
Figure 2C:
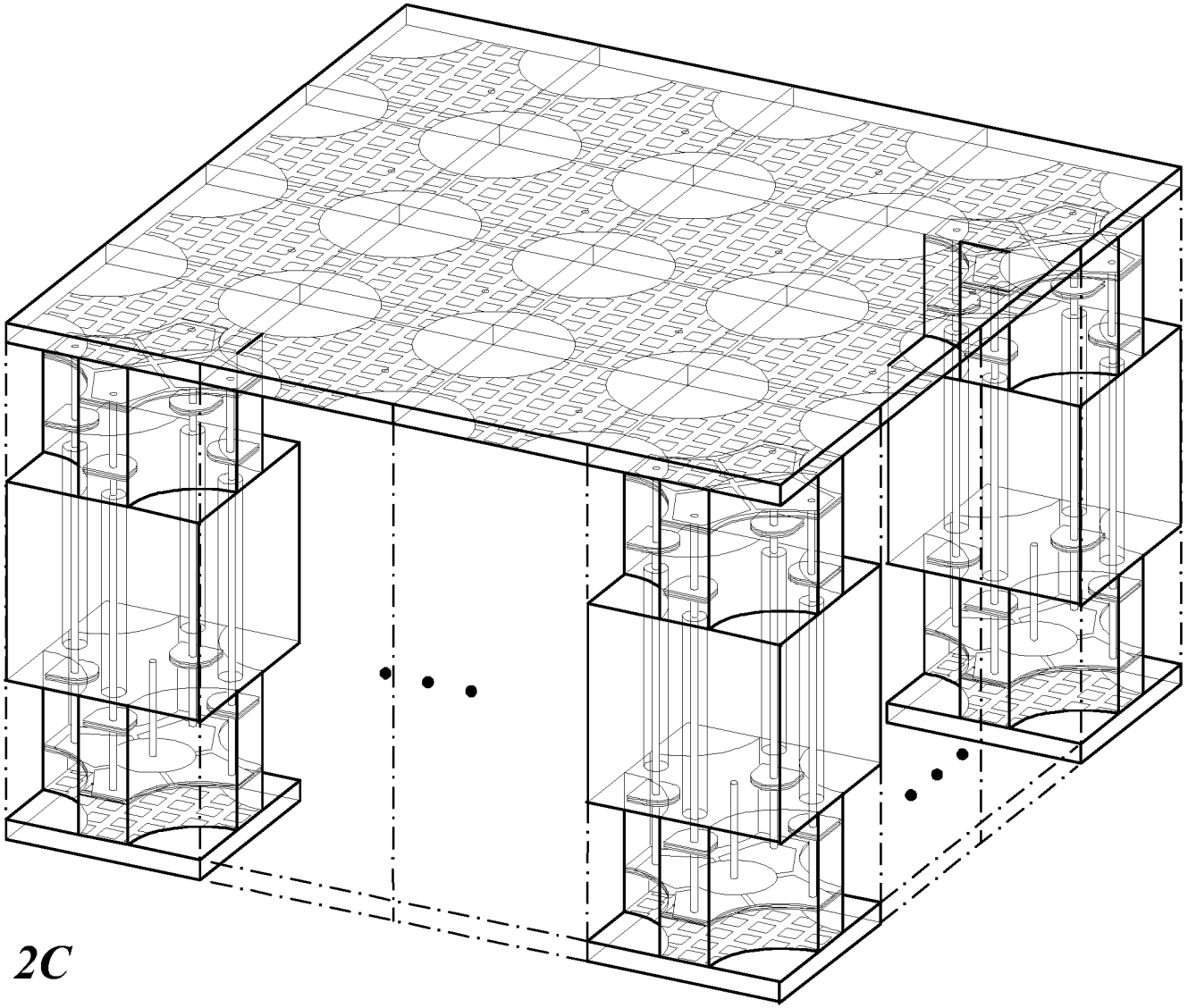
FIG. 2C schematically shows a perspective view of a four-by-four repetition of the unit cell of the four-feedthrough TCDA embodiment.

In FIGS. 2A through 2C (collectively, FIG. 2) are shown portions of an armored radome in accordance with a first dual-polarized, tightly-coupled dipole array (TCDA) embodiment of the concepts, structures, and techniques disclosed herein. More particularly, FIG. 2A shows a top view of a unit cell 200 (with an optional FSS not shown for clarity). FIG. 2B shows a perspective view of the unit cell 200. The armored radome of the embodiment is formed by physically repeating the unit cell 200 in each lateral direction, for example as shown in FIG. 2C, until the radome has a desired size and shape. The armored radome so constructed may be, for example, the armored radome 100 of FIG. 1.

The unit cell 200 includes a portion 205 of a ground plane (e.g. the ground plane 130). The ground plane may be a metallic conductor, or a metal coated with a conductor, or a dielectric coated with a conductor, or any other suitable configuration of materials having the mechanical and electrical properties required herein. The unit cell 200 also includes a portion 210 of a first radiator structure (e.g. the antenna 120). And the unit cell 200 includes a portion 220 of a second radiator structure (e.g. the antenna 140). Note that the unit cell 200 includes holes through the first and second radiator structures, which are primarily composed of a dielectric material. These holes in the dielectric eliminate material and reduce the effective dielectric constant of these structures, improving performance.

The portion 210 of the first radiator structure includes four pentagonal antenna elements 212*a*-212*d*. Each such pentagonal element is one half of a dipole, with the other half of the dipole being in an adjacent element. It is appreciated that a unit cell for an array antenna in accordance with the concepts, structures, and techniques disclosed herein may have greater or fewer than four antenna elements, and that these elements may have different shapes, sizes, and physical arrangements according to application requirements of the armored radome.

The antenna elements 212*a*-212*d* are electrically coupled to the portion 205 of the ground plane by corresponding conductors 214*a*-214*d*. The purposes of the portion conductor 214 include, among other things, to mitigate low-frequency bandwidth limiting loop modes, to shift common-mode resonances out-of-band, and to augment dipole-to-dipole capacitance which is critical to low frequency performance. See, for example, U.S. application Ser. No. 16/415,292, filed May 17, 2019 and titled "Antenna Element Having A Segmentation Cut Plane".

The portion 210 of the first radiator structure also illustratively includes an optional frequency selective surface (FSS) 216. The FSS 216 is layered on the antenna elements 212*a*-212*d* opposite the ground plane. The design, purpose, and operation of the FSS 216 is described in general in connection with FIG. 1.

In the illustrative first embodiment of FIG. 2, the portion 220 of the second radiator structure is a mirror image of the portion 210 of the first radiator structure. Thus, the portion 220 includes four pentagonal antenna elements 222*a*-222*d*. Each of the antenna elements 222*a*-222*d* has the same shape and size as a corresponding antenna element 212*a*-212*d*, and corresponding antenna elements are in vertical registration with each other. As corresponding antenna elements have substantially identical electrical properties, electrical signals received in one antenna element may be reradiated by the corresponding antenna element with minimal attenuation. The antenna elements 222*a*-222*d* are electrically coupled to the portion 205 of the ground plane by a conductor 224. The portion 220 of the second radiator structure illustratively includes a second optional FSS 226.

In the first TCDA embodiment of FIG. 2, each of the corresponding pairs of antenna elements (212*a*, 222*a*) to (212*d*, 222*d*) is provided with a respective coaxial feedthrough 218*a*-218*d* that couples the pair of antenna elements, to propagate electrical signals received by one antenna element to the other antenna element. The coaxial feedthroughs 218*a*-218*d* may be made of any suitable conductors.

In the illustrative wideband radiator embodiment of FIG. 2, there are four coaxial feedthroughs 218*a*-218*d*, corresponding to couplings for all four arms of the two orthogonal dipoles in each unit cell 200. Due to the presence of these couplings in the four-feedthrough embodiment, the unit cell 200 is symmetric under rotations around the vertical axis in multiples of 90 degrees, and has a low induced cross polarization.

Figure 3A:
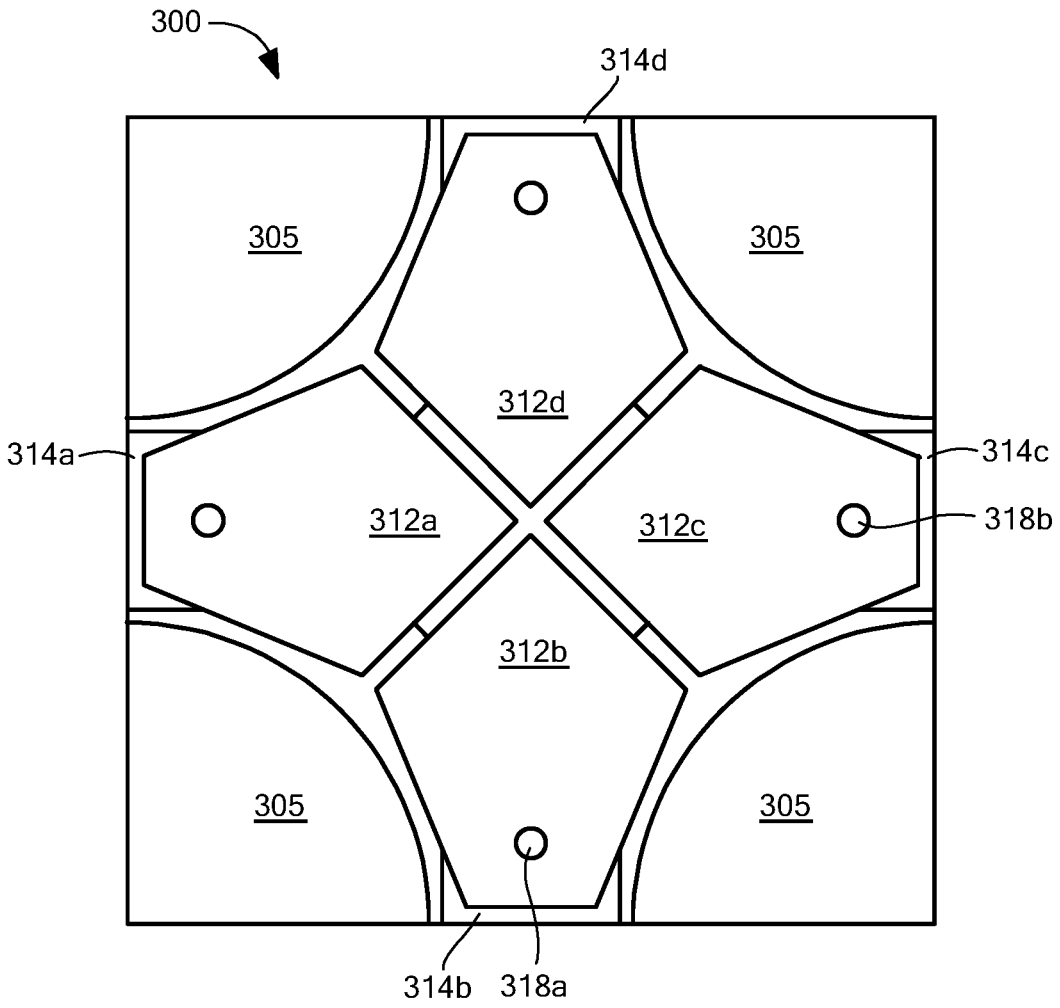
FIG. 3A schematically shows a top view of a unit cell of an armored radome in accordance with a second TCDA embodiment having two coaxial feedthroughs per unit cell, one for each orthogonal dipole, with cover layers removed for clarity.
Figure 3B:
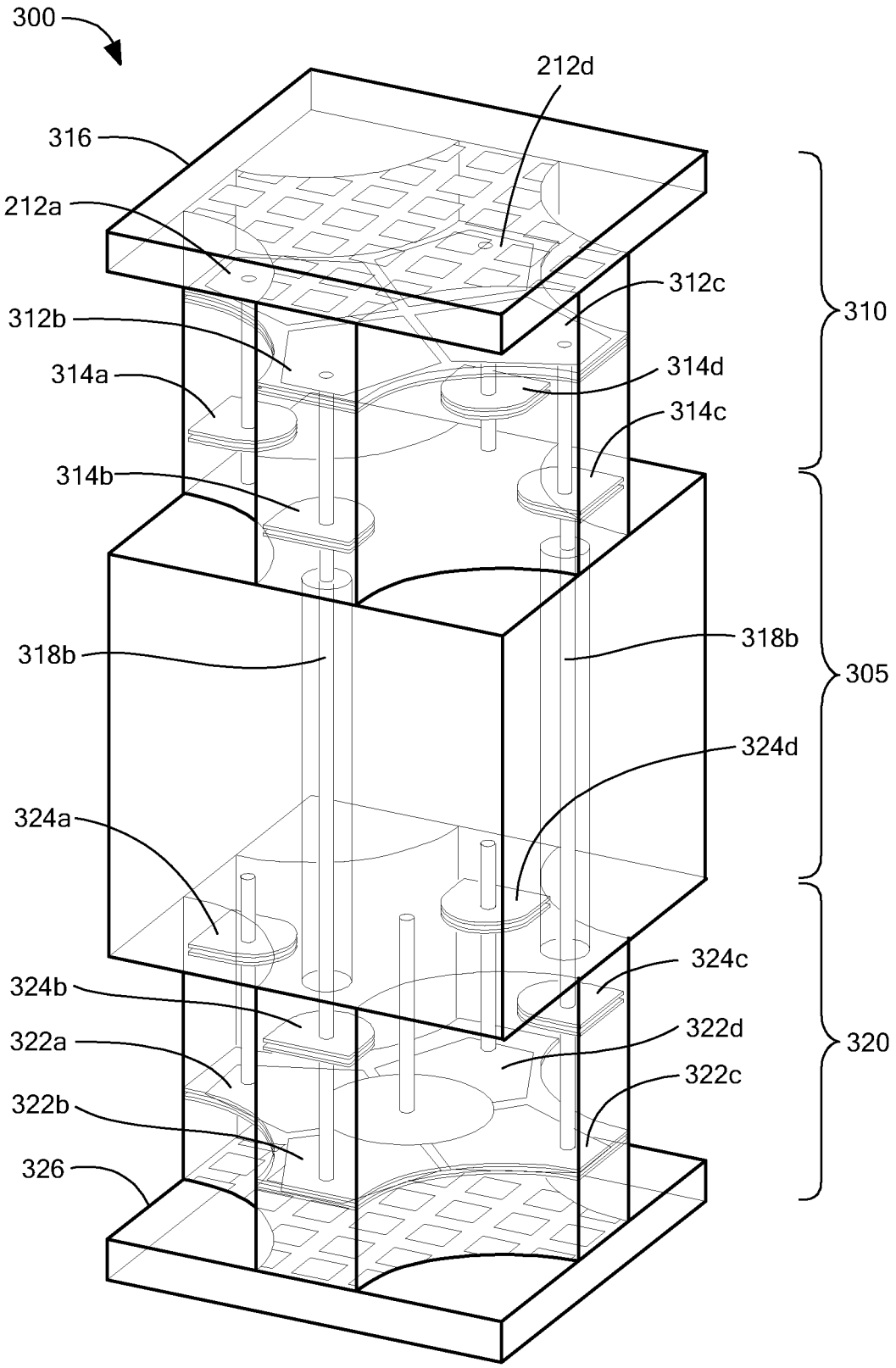
FIG. 3B schematically shows a perspective view of the unit cell of the two-feedthrough TCDA embodiment.
Figure 3C:
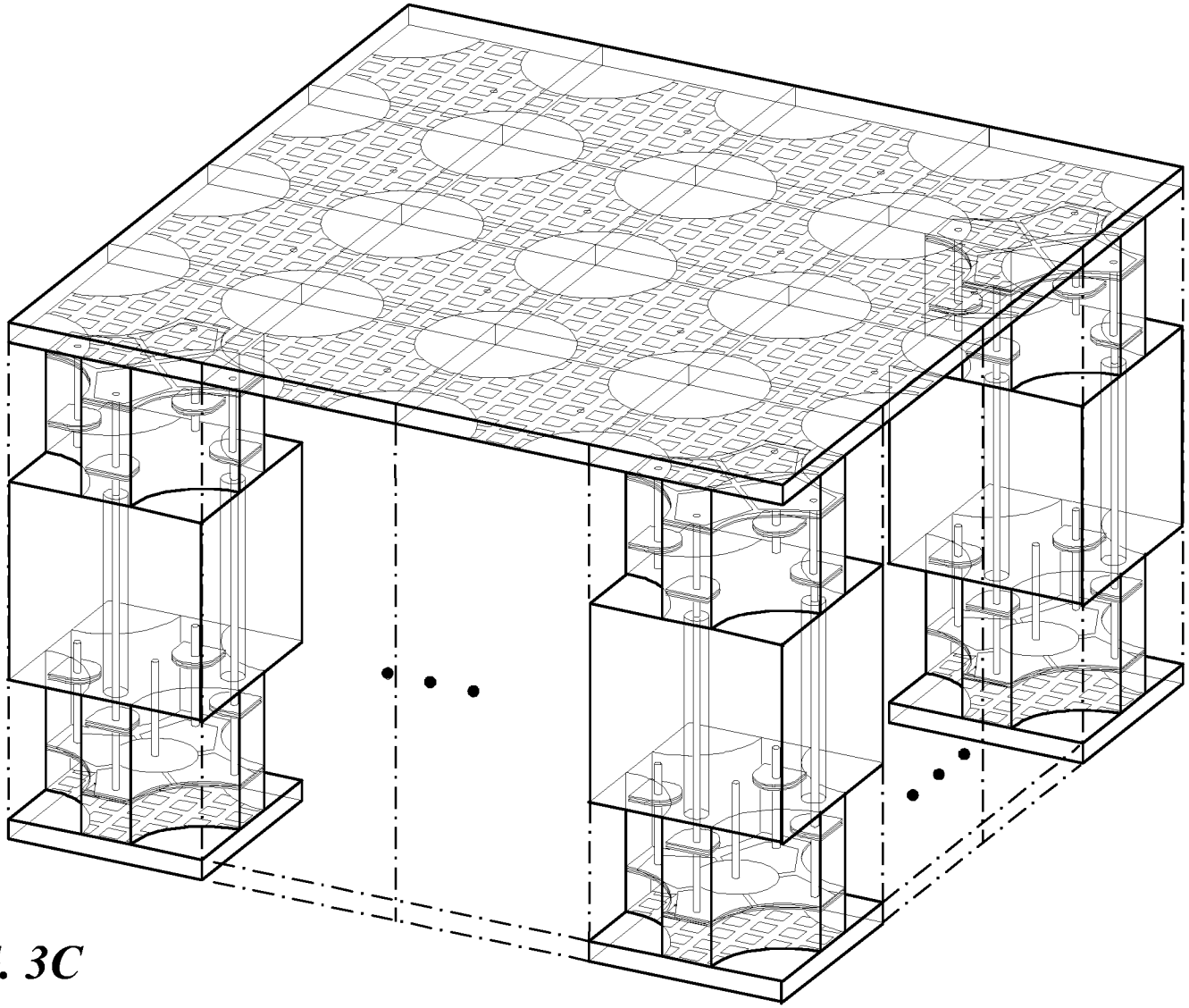
FIG. 3C schematically shows a perspective view of a four-by-four repetition of the unit cell of the two-feed-through TCDA embodiment.

In FIGS. 3A through 3C (collectively, FIG. 3) are shown portions of an armored radome in accordance with a second dual-polarized, tightly-coupled dipole array (TCDA) embodiment of the concepts, structures, and techniques disclosed herein. More particularly, FIG. 3A shows a top view of a unit cell 300 (with an optional FSS not shown for clarity). FIG. 3B shows a perspective view of the unit cell 300. The armored radome of the embodiment is formed by physically repeating the unit cell 300 in each lateral direction, for example as shown in FIG. 3C, until the radome has a desired size and shape. The armored radome so constructed may be, for example, the armored radome 100 of FIG. 1.

The unit cell 300 includes a portion 305 of a ground plane (e.g. the ground plane 130). The ground plane may be a metallic conductor, or a metal coated with a conductor, or a dielectric coated with a conductor, or any other suitable configuration of materials having the mechanical and electrical properties required herein. The unit cell 300 also includes a portion 310 of a first radiator structure (e.g. the antenna 120). And the unit cell 300 includes a portion 320 of a second radiator structure (e.g. the antenna 140). Note that the unit cell 300 includes holes through the first and second radiator structures, which are primarily composed of a dielectric material. These holes in the dielectric eliminate material and reduce the effective dielectric constant of these structures, improving performance.

The portion 310 of the first radiator structure includes four pentagonal antenna elements 312*a*-312*d*, Each such pentagonal element is one half of a dipole, with the other half of the dipole being in an adjacent element. It is appreciated that a unit cell for an array antenna in accordance with the concepts, structures, and techniques disclosed herein may have greater or fewer than four antenna elements, and that these elements may have different shapes, sizes, and physical arrangements according to application requirements of the armored radome.

The antenna elements 312*a*-312*d* are electrically coupled to the portion 305 of the ground plane by corresponding conductors 314*a*-314*d*. The purposes of the portion conductor 314 include, among other things, to mitigate low-frequency bandwidth limiting loop modes, to shift common-mode resonances out-of-band, and to augment dipole-to-dipole capacitance which is critical to low frequency performance.

The portion 310 of the first radiator structure also illustratively includes an optional frequency selective surface (FSS) 316. The FSS 316 is layered on the antenna elements 312*a*-312*d* opposite the ground plane. The design, purpose, and operation of the FSS 316 is described in general in connection with FIG. 1.

In the illustrative first embodiment of FIG. 3, the portion 320 of the second radiator structure is a mirror image of the portion 310 of the first radiator structure. Thus, the portion 320 includes four pentagonal antenna elements 322*a*-322*d*, Each of the antenna elements 322*a*-322*d* has the same shape and size as a corresponding antenna element 312*a*-312*d*, and corresponding antenna elements are in vertical registration with each other. As corresponding antenna elements have substantially identical electrical properties, electrical signals received in one antenna element may be reradiated by the corresponding antenna element with minimal attenuation. The antenna elements 322*a*-322*d* are electrically coupled to the portion 305 of the ground plane by a conductor 324. The portion 320 of the second radiator structure illustratively includes a second optional FSS 326.

In the second TCDA embodiment of FIG. 3, only two of the four corresponding pairs of antenna elements (312*a*, 322*a*) to (312*d*, 322*d*) are provided with a respective feedthrough. To be concrete, the pair (312*b*, 322*b*) is provided with a coaxial feedthrough 318*a*, and the pair (312*c*, 322*c*) is provided with a coaxial feedthrough 318*b*. Each such feedthrough couples the respective pair of antenna elements, to propagate electrical signals received by one antenna element to the other antenna element. The coaxial feedthroughs 318*a* and 318*b* may be made of any suitable conductors.

In the illustrative wideband radiator embodiment of FIG. 3, there are two coaxial feedthroughs 318*a* and 318*b* per unit cell. Thus, only one half of each dipole is coupled to a coaxial feedthrough; the other half is grounded using a via.

The illustrative embodiments of FIGS. 2 and 3 relate to antennas designed for a particular wideband application. It is appreciated, however, that the concepts, techniques, and structures disclosed herein may be used in a variety of other applications, and with a variety of other antenna designs. Thus, FIGS. 4A, 4B, 5A, and 5B show that dipoles of two patch antenna elements may likewise be coupled across a ground plane according to embodiments having different numbers of coaxial feedthroughs, and a person having ordinary skill in the art should see how to embody the teachings herein to antenna arrays having other designs.

Figure 4A:
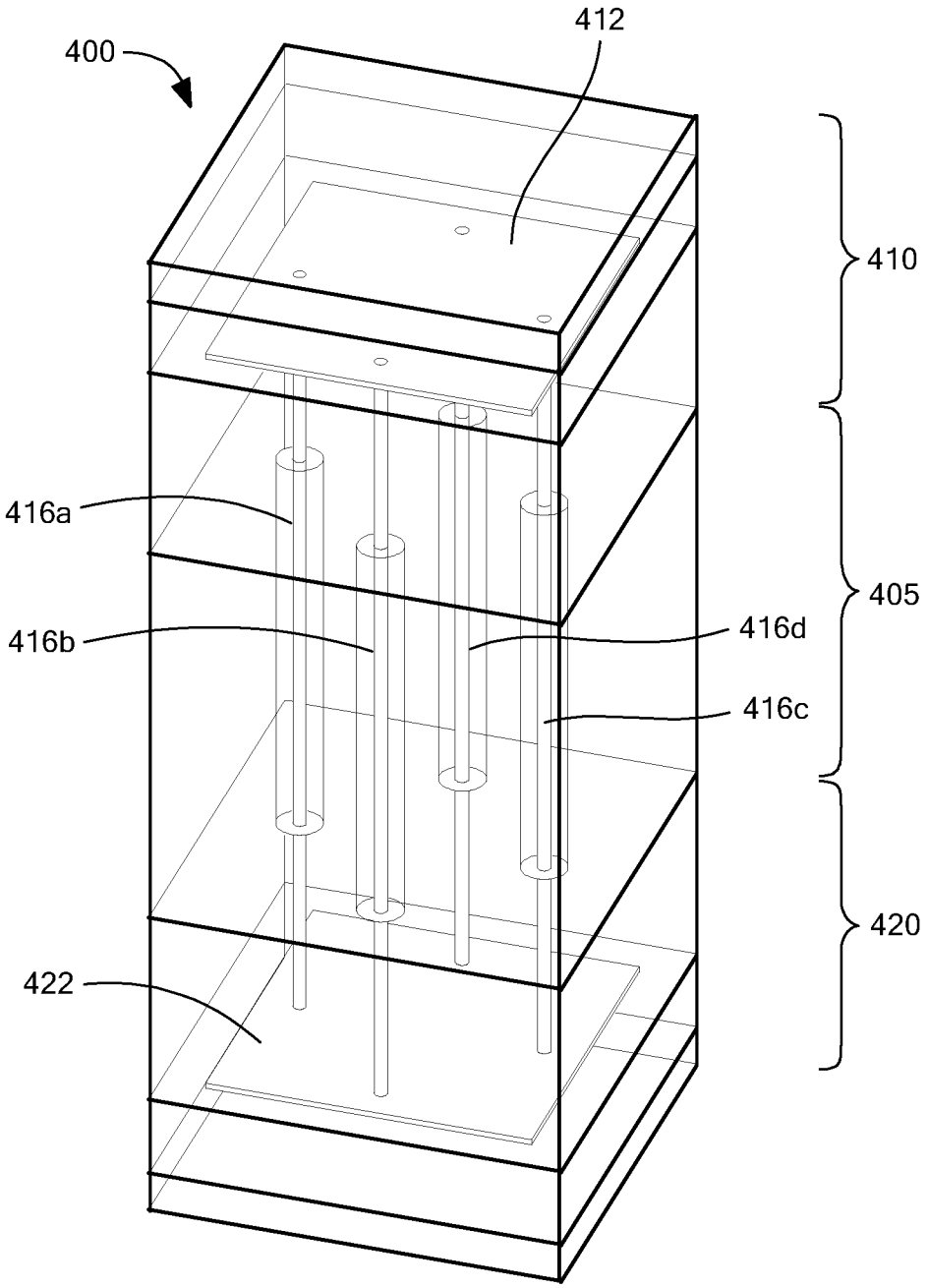
FIG. 4A schematically shows a perspective view of a unit cell of an armored radome in accordance with a first dual-polarized, patch antenna array embodiment having four coaxial feedthroughs per unit cell, two for each orthogonal dipole.
Figure 4B:
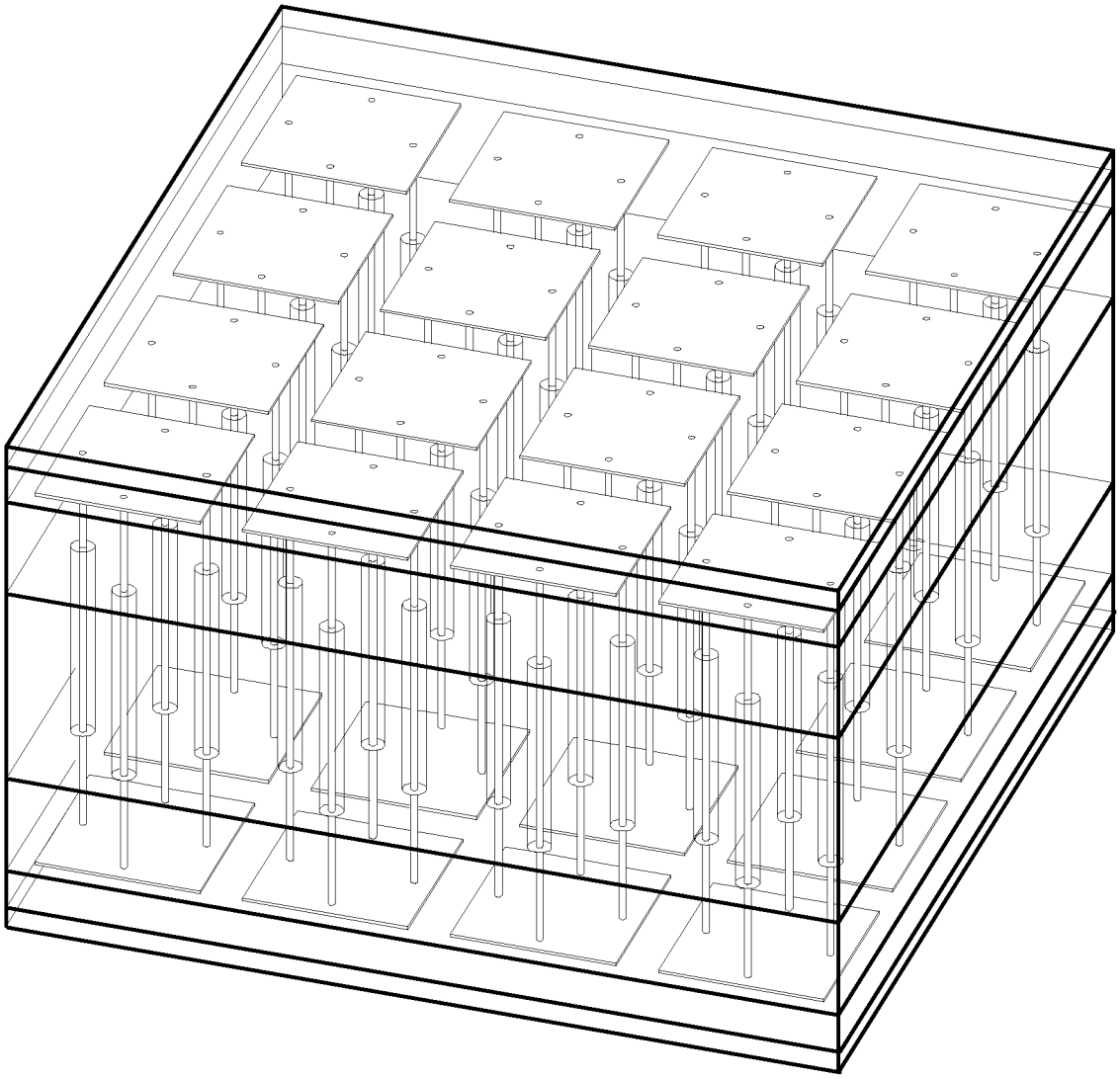
FIG. 4B schematically shows a perspective view of a four-by-four repetition of the unit cell of the four-feed-through patch antenna array embodiment.

In FIG. 4A is schematically shown a perspective view of a unit cell 400 of an armored radome in accordance with a first dual-polarized, patch antenna array embodiment having four coaxial feedthroughs per unit cell, two for each orthogonal dipole. The armored radome of the embodiment is formed by physically repeating the unit cell 400 in each lateral direction, for example as shown in FIG. 4B, until the radome has a desired size and shape. The armored radome so constructed may be, for example, the armored radome 100 of FIG. 1.

The unit cell 400 includes a portion 405 of a ground plane (e.g. the ground plane 130). The ground plane may be a metallic conductor, or a metal coated with a conductor, or a dielectric coated with a conductor, or any other suitable configuration of materials having the mechanical and electrical properties required herein. The unit cell 400 also includes a portion 410 of a first radiator structure (e.g. the antenna 120). And the unit cell 400 includes a portion 420 of a second radiator structure (e.g. the antenna 140).

The portion 410 of the first radiator structure includes a single patch antenna element 412. In the illustrative first embodiment of FIG. 4A, the portion 420 of the second radiator structure is a mirror image of the portion 410 of the first radiator structure. Thus, the portion 420 includes a single patch antenna element 422, and the antenna elements 412 and 422 are in vertical registration with each other. As corresponding antenna elements have substantially identical electrical properties, electrical signals received in one antenna element may be reradiated by the corresponding antenna element with minimal attenuation.

In the first patch array embodiment of FIG. 4A, the pair of antenna elements 412, 422 is provided with four coaxial feedthroughs 416*a*-416*d* that couple the pair of antenna elements, to propagate electrical signals received by one antenna element to the other antenna element. The coaxial feedthroughs 416*a*-416*d* may be made of any suitable conductors.

Figure 5A:
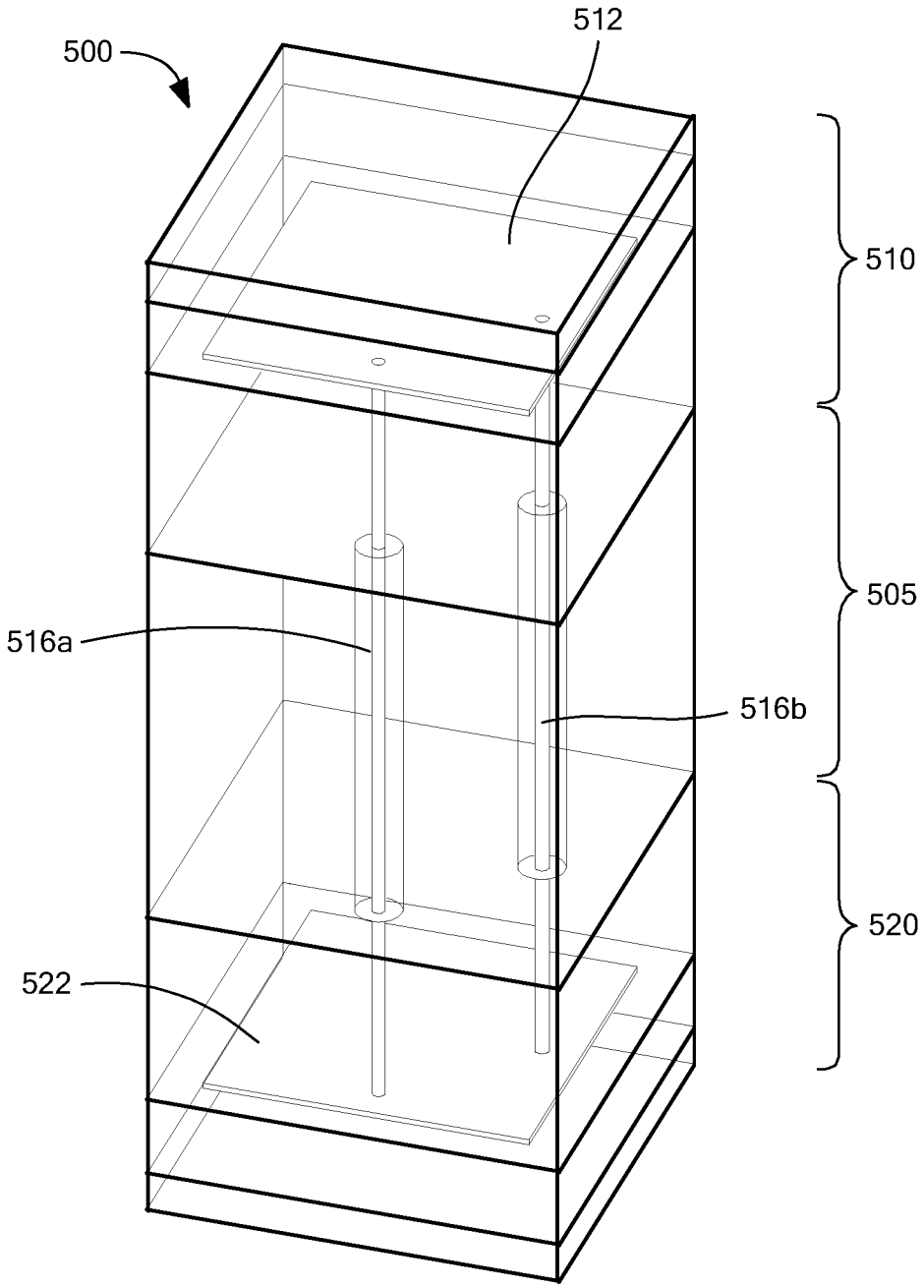
FIG. 5A schematically shows a perspective view of a unit cell of an armored radome in accordance with a second dual-polarized, patch antenna array embodiment having two coaxial feedthroughs per unit cell, one for each orthogonal dipole.
Figure 5B:
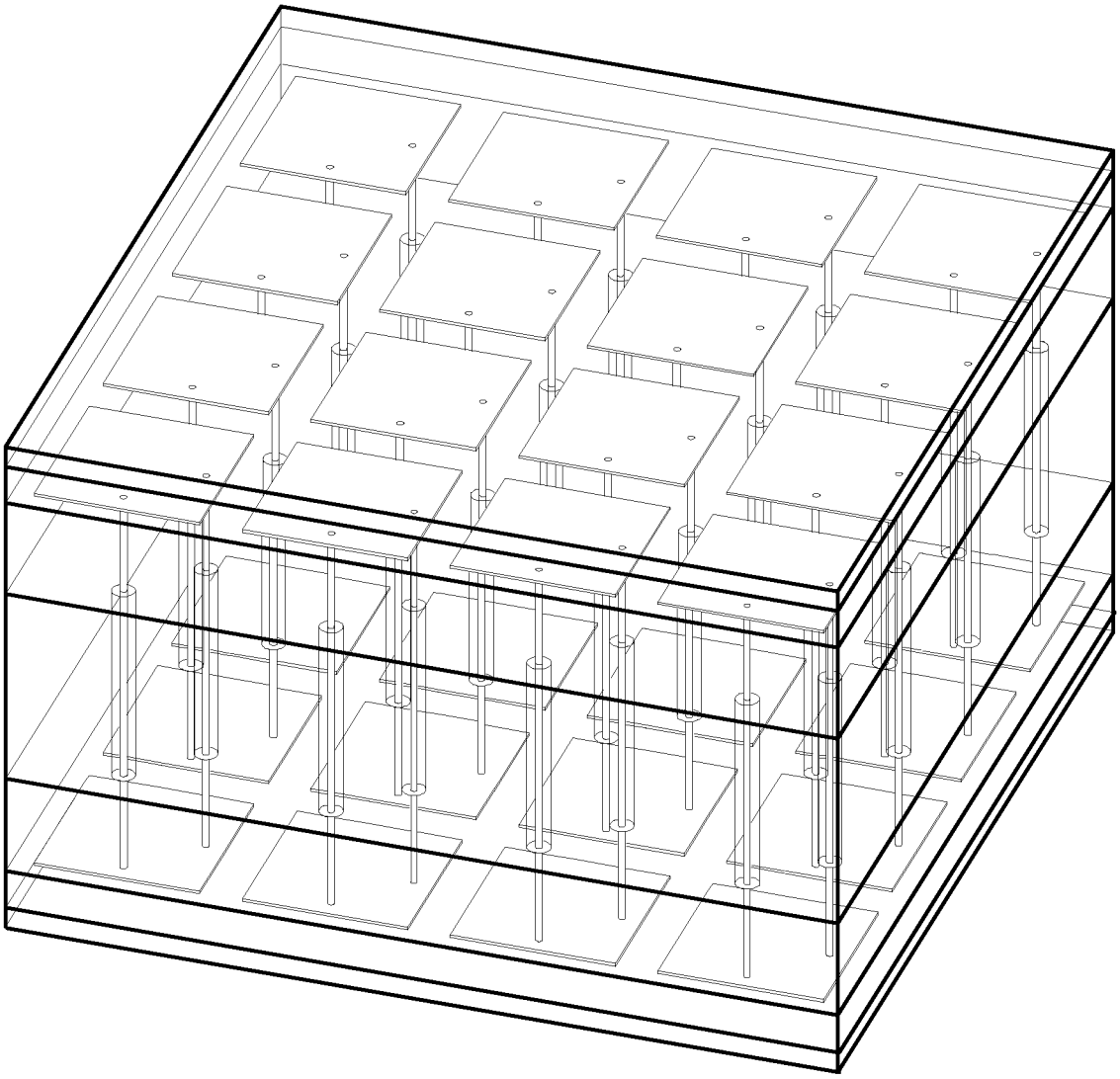
FIG. 5B schematically shows a perspective view of a four-by-four repetition of the unit cell of the two-feed-through patch antenna array embodiment.

Likewise, in FIG. 5A is schematically shown a perspective view of a unit cell of an armored radome in accordance with a second dual-polarized, patch antenna array embodiment having two coaxial feedthroughs per unit cell, one for each orthogonal dipole. The armored radome of the embodiment is formed by physically repeating the unit cell 500 in each lateral direction, for example as shown in FIG. 5B, until the radome has a desired size and shape. The armored radome so constructed may be, for example, the armored radome 100 of FIG. 1.

The unit cell 500 includes a portion 505 of a ground plane (e.g. the ground plane 130). The ground plane may be a metallic conductor, or a metal coated with a conductor, or a dielectric coated with a conductor, or any other suitable configuration of materials having the mechanical and electrical properties required herein. The unit cell 500 also includes a portion 510 of a first radiator structure (e.g. the antenna 120). And the unit cell 500 includes a portion 520 of a second radiator structure (e.g. the antenna 140).

The portion 510 of the first radiator structure includes a single patch antenna element 512. In the illustrative first embodiment of FIG. 5A, the portion 520 of the second radiator structure is a mirror image of the portion 510 of the first radiator structure. Thus, the portion 520 includes a single patch antenna element 522, and the antenna elements 512 and 522 are in vertical registration with each other. As corresponding antenna elements have substantially identical electrical properties, electrical signals received in one antenna element may be reradiated by the corresponding antenna element with minimal attenuation.

In the second patch array embodiment of FIG. 5A, the pair of antenna elements 512, 522 is provided with two coaxial feedthroughs 516*a* and 516*b* that couple the pair of antenna elements, to propagate electrical signals received by one antenna element to the other antenna element. The coaxial feedthroughs 516*a* and 516*b* may be made of any suitable conductors.

In the foregoing detailed description, various features of embodiments are grouped together in one or more individual embodiments for the purpose of streamlining the disclosure. This method of disclosure is not to be interpreted as reflecting an intention that the claims require more features than are expressly recited therein. Rather, inventive aspects may lie in less than all features of each disclosed embodiment.

Having described implementations which serve to illustrate various concepts, structures, and techniques which are the subject of this disclosure, it will now become apparent to those of ordinary skill in the art that other implementations incorporating these concepts, structures, and techniques may be used. Accordingly, it is submitted that that scope of the patent should not be limited to the described implementations but rather should be limited only by the spirit and scope of the following claims.

What is claimed is:

1. A radome for a radio frequency (RF) sensor, the radome comprising:

an electrically-conductive ground plane providing ballistic protection to the RF sensor;

a first radiator structure coupled to a first surface of the ground plane for receiving RF signals in a given frequency range; and a second radiator structure coupled to a second, opposing surface of the ground plane for reradiating the received RF signals toward the RF sensor;

wherein the first radiator structure and the second radiator structure each include an array antenna; and wherein the ground plane includes a plurality of coaxial feedthroughs coupling the array antenna of the first radiator structure to the array antenna of the second radiator structure.

2. The radome of claim 1, wherein the array antenna of the first radiator structure and the array antenna of the second radiator structure each comprise dual-polarized antenna elements.

3. The radome of claim 2, wherein the coaxial feedthrough comprises, for each of the dual polarizations, a coaxial feedthrough from an element in the first radiator structure to a corresponding element in the second radiator structure.

4. The radome of claim 2, wherein the coaxial feedthrough comprises, for each of the dual polarizations, two coaxial feedthroughs from an element in the first radiator structure to a corresponding element in the second radiator structure.

5. The radome of claim 1, wherein the given frequency range includes a portion of the radio spectrum between 1 GHz and 100 GHz.

6. The radome of claim 1, wherein each of the array antennas includes a plurality of array elements, and the ground plane includes coaxial feedthroughs for communicating the received RF signals from each antenna element in the first radiator structure to a corresponding, physically-aligned antenna element in the second radiator structure.

7. The radome of claim 1, wherein the electrically conductive ground plane comprises a metallic conductor, or a metal coated with a conductor, or a dielectric coated with a conductor.

8. The radome of claim 1, wherein the first radiator structure, or the second radiator structure, or both, further comprise a frequency-selective surface (FSS) according to the given frequency range.

9. The radome of claim 8, further comprising an additional FSS for shaping a frequency response of the radome.

10. The radome of claim 8, wherein each FSS comprises a dielectric having one or more layers of patterned conductor.

11. The radome of claim 8 wherein the first radiator structure comprises a first FSS, the second radiator structure comprises a second FSS, and the first FSS and the second FSS share a surface periodicity but are made from different materials.

12. The radome of claim 1, wherein each antenna array comprises a tightly-coupled dipole array or a patch antenna array.

* * * * *